United States Patent [19]

Cross

[11] Patent Number: 4,696,118

[45] Date of Patent: Sep. 29, 1987

[54] DESK CALENDAR

[76] Inventor: Carroll N. Cross, 1104 E. Lakeview Cir., Altamonte Springs, Fla. 32714

[21] Appl. No.: 803,147

[22] Filed: Dec. 2, 1985

[51] Int. Cl.[4] ..... G09D 3/04

[52] U.S. Cl. ..... 40/120; 40/124.1

[58] Field of Search ..... 40/120, 124.1, 158, 40/159, 152.1

[56] References Cited

U.S. PATENT DOCUMENTS

| | | | |
|---|---|---|---|
| 3,117,757 | 1/1964 | Sampson | 40/120 |
| 3,198,339 | 8/1965 | Stolarz | 248/359 |
| 3,210,874 | 10/1965 | Nichols | 248/359 |
| 3,370,368 | 2/1968 | Paschal | 248/359 |

FOREIGN PATENT DOCUMENTS

| | | | |
|---|---|---|---|
| 725492 | 1/1966 | Canada | 248/459 |

*Primary Examiner*—Gene Mancene
*Assistant Examiner*—Wenceslao J. Contreras
*Attorney, Agent, or Firm*—William M. Hobby, III

[57] ABSTRACT

A display mount has four panels of lined paperboard with the first panel flexibly hinged to the second panel and the second panel flexibly hinged to the third panel and the third panel hinged to the fourth panel with a ductile hinge material. The first and second panels are substantially the same length and width with the third panel being of a shorter length than the first and second panels and the fourth panel being of a shorter length then the first, second and third panels. The fourth panel can be bent on its ductile hinge relative to the third panel which can be placed on a flat surface. The first and second panels can be folded to lay across the edge of the fourth panel as a slant type easel back desk calendar. The first panel can also be propped on the third panel to act as an upright type desk calendar and the first and second panels can be folded forward onto a flat surface for viewing referenced material or writing on the inside surface of one of the panels or on paper sheet supported thereto.

9 Claims, 12 Drawing Figures

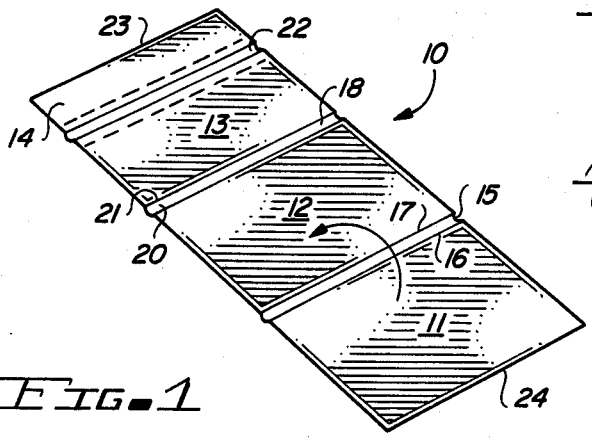
FIG. 1
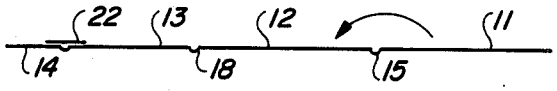
FIG. 5
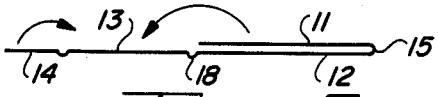
FIG. 6
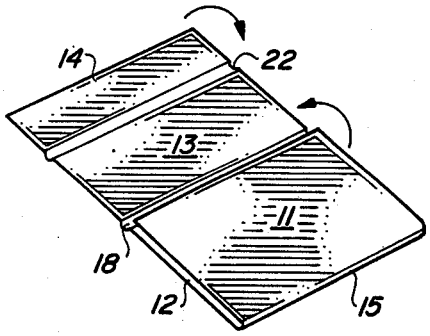
FIG. 2
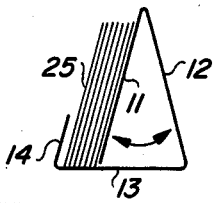
FIG. 7
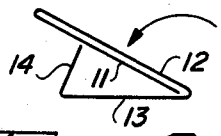
FIG. 8
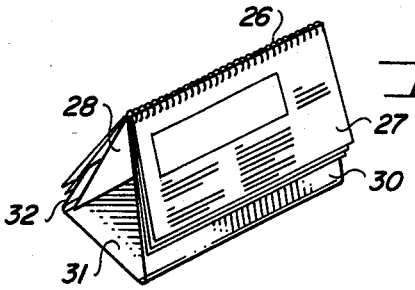
FIG. 9
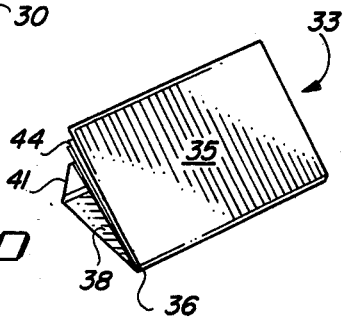
FIG. 10
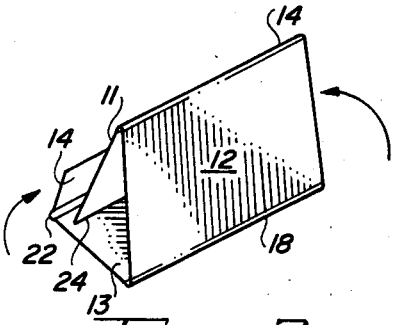
FIG. 3
FIG. 11
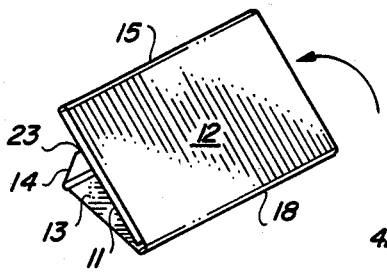
FIG. 4
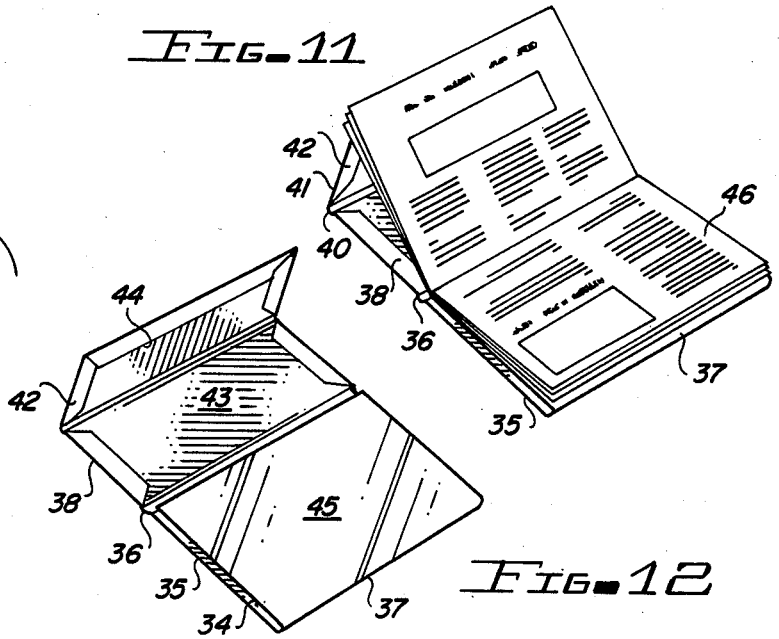
FIG. 12

DESK CALENDAR

BACKGROUND OF THE INVENTION

The present invention relates to a display mount and calendar which can act as a slant type calendar or as an upright type calendar and can be used to hold reference or writing material.

In the past, a great variety of displays for displaying calendars and the like have been provided. Typically, these display mounts are made of cardboard which has a plurality of calendar leaves attached by staples, stitches, or placed in pockets on the display mount. The display may be provided with some means for supporting the display, such as having a rear hinged to the other to hold the panels in position. It has also been common in the past to provide a wide variety of reference books placed for handy use adjacent a telephone, such as may be attached to the phone to provide a ready reference for phone numbers, addresses, and other commonly used information. These prior type displays and phone books are frequently provided free by companies to their customers and potential customers with their advertising material printed on the display mount or on the reference books. The present invention is directed toward a multi-use calendar display which may contain conventional advertising material thereon, which also has a phone or reference book formed therein in which the display mount acts as a cover for the book.

Typical display mounts for calendar pads and the like may be seen in my prior U.S. Pat. No. 2,355,706 for a display mount having a well in the face thereof for displaying materials such as calendar pads, and in U.S. Pat. No. 3,058,410 and U.S. Pat. No. 3,079,715 for an improved display mount structure and improved method for forming the display windows and display wells in display mount structures. In addition, my prior patents on display and photomounts may be seen in U.S. Pat. No. 3,216,582; U.S. Pat. No. 3,068,139; and U.S. Pat. No. 3,002,720, which include my patent on an aluminum hinge which allows a supporting prop or other display mount supports to be mounted with a flexible hinged panel which stays in place without the use of interconnecting tongues, or the like. Other display mount patents of mine include a Display Mount Apparatus and Method, U.S. Pat. No. 4,523,399; a Display Mount, U.S. Pat. No. 4,199,883; a Display Mount and Method, U.S. Pat. No. 4,351,123; a Display Mount with Protected Thermometer, U.S. Pat. No. 4,263,733; a Display Mount and Method, U.S. Pat. No. 4,326,906; a Method of Making a Display Mount, U.S. Pat. No. 4,285,683; and a Method of Making a Hinged Display Mount, U.S. Pat. No. 4,299,643.

In my prior Patent for Display Book Apparatus, U.S. Pat. No. 4,288,935, I combined a display and book combination which allowed a calendar to swing forward to give access for a phone or reference book.

The present desk calendar solves a problem for the purchaser and user of an easel back desk calendar who must decide whether to use an upright type calendar for across the desk viewing or a slant type desk calendar for easy writing of memos and appointments on the calendar surface. The upright type desk calendar has an angle substantially more then forty-five degrees in relation to a flat desk while the slant style calendar has an angle less then forty-five degrees. Both types of calendars are desirable at different times by the same user for better viewing and other times for writing at an angle.

The present desk calendar has a third position in which two panels can lie flat on a desk for writing names and phone numbers on the inside of the multiple panels. It has been suggested in the past for a single upright or slant type calendar to be folded flat on a desk for writing, but the present invention achieves this with the combination upright and slant type calendar combination, which is achieved by using variable lengths of four panels, only one of which is parallel with the desk for normal use.

DESCRIPTION OF THE DRAWING

FIG. 1 is a perspective view of a display mount in accordance with my invention with the panels laid out flat.

FIG. 2 is a perspective view of a display mount in accordance with claim 1, having one folded panel.

FIG. 3 is a perspective view of a display mount in accordance with claims 1 and 2 with the panels folded into an upright position.

FIG. 4 is a perspective view of a display mount in accordance with claims 1 through 3 with the panels folded into a second position.

FIG. 5 is a side elevation of the display mount of FIG. 1.

FIG. 6 is a side elevation of the display mount of FIG. 2.

FIG. 7 is a side elevation of the display mount of FIG. 3 having papers supported therein.

FIG. 8 is a side elevation of the display mount of FIG. 4.

FIG. 9 is a perspective view of another embodiment of a display mount with the panels folded into an upright position and having a spiral bound paper thereon.

FIG. 10 is a perspective view of another embodiment of a display mount with the panels folded into an upright position and having paper supported therein.

FIG. 11 is a perspective view of a display mount in accordance with FIG. 10 with the panels folded to display the paper supported therein, and FIG. 12 is a perspective view of another embodiment of a display mount with case bound panels.

SUMMARY OF THE INVENTION

A display mount desk calendar has first, second, third and fourth panels. The first panel is hinged to the second panel with a flexible hinge and the second panel is hinged to the third panel with a flexible hinge while the third panel is hinged to the fourth panel with a ductile hinge material. The first and second panels are substantially the same length and width. The third panel has a shorter length than the first and second panels, and the fourth panel has a shorter length than the first, second and third panels. The third panel can be set on a flat surface and the fourth panel can be bent on its ductile hinge relative to the third panel so that the first and second panels can be folded to lay on the edge of the fourth panel to provide a slant type calendar. The first and second panels can also be folded for the edge of the first panel to rest upon the third panel to provide an upright type of desk calendar, and the first and second panels can be folded forward onto a flat surface for viewing referenced material or writing a note on the panels or on a pad of paper supported to the first and second panels. One or more multiple pages of the panels can be banded for holding a pad of paper or indicia, also loose paper and envelopes can be supported between the fourth upright panel and the first panel in an upright position.

DESCRIPTION OF THE PREFERRED EMBODIMENTS

Referring to the drawings and especially to FIGS. 1 through 8, a display mount or display calendar 10 is illustrated having a first panel 11, a second panel 12, a third panel 13 and a fourth panel 14. The panels are all of substantially the same width and the panels 11 and 12 are substantially the same size. The panels 11 and 12 have a flexible hinge 15 therebetween along their edges 16 and 17. Panels 12 and 13 have a flexible hinge 18 therebetween connecting the panel edges 20 and 21. The panels 13 and 14 have a ductile hinge material 22 such as a thin strip of aluminum, connected therebetween to form a ductile hinge. The panels 11 and 12 are substantially the same size while panel 13 is smaller than panels 11 and 12 but larger then panel 14. Panel 14 is substantially the same width as the other panels but of shorter length and has a support edge 23 along the edge parallel to the hinged edge, while panel 11 has edge 24 parallel to the hinge 15.

In FIGS. 1 and 5, the panels are laid out flat showing the direction of fold between panels 11 and 12, while FIGS. 2 and 6 shows the first panel 11 folded over on the second panel 12, and in FIGS. 3 and 7 the fourth panel 14 is folded on the ductile hinge material 22 into an upright position leaving the third panel 13 flat upon a surface. A second panel 12 is folded on its hinge 18 while the first panel 11 is folded on hinge 15 and has the edge 24 sitting on the panel 13 to form an upright type easel back desk calendar which can be viewed from a distance.

In FIGS. 4 and 8, the same calendar has the first panel 11 folded beneath the panel 12 and sitting on the edge 23 of the fourth panel 14 to form a slant type desk calendar having an angle of less then forty-five degrees to thereby allow the calendar or surface of the panel 12 to be written upon as well as viewed.

FIG. 7 illustrates how the upright type of desk calendar shown in FIG. 3 can have a plurality of papers or envelopes 25 supported therein. In FIG. 9, the embodiment shown in the other Figures has been modified by having the hinge 15 shown as a spiral binder 26 supporting a plurality of sheets of paper 27 as well as binding a first panel 28 to a second panel 30. The second panel 30 is hinged to a third panel 31 which is connected by a ductile hinge to a fourth panel 32. Thus the spiral binding binds a pad of paper between the first and second panels 28 and 30, while binding the panels together but continues the benefit of a desk calendar which can be used as a slant type of calendar or as an upright type of calendar.

Turning to FIGS. 10, 11 and 12, an alternate embodiment of a display mount 33 is illustrated as having a first panel 34 smaller then the second panel 35 and hinged thereto with a hinge 37. The second panel 35 is hinged at 36 to the third panel 38 which is hinged with a ductile aluminum hinge 40 to the fourth panel 41. The case binding 42 can be seen covering all of one side of the panels with the inside of the case binding being covered with a lined paper 43 for holding addresses, phone numbers, and the like. The pad of papers or printed sheet material 44 is attached to the first panel with a Glaslite or other polymer sleeve 45 banded therearound for sliding the bottom page of the padded material thereinto. A calendar can be stapled or inserted in a pocket over panel 85 in a slanted position for holding a calendar for writing upon and can be folded forward, such as shown in FIG. 11 for displaying information and a reference section secured inside the transparent polymer sleeve 34, and also for having phone numbers and addresses on the lined surface 43. A writing surface 46 shown as lines in FIG. 11. The polymer sleeve without the pad is shown in FIG. 12.

It should be clear at this point that four panels of lined board, such as paper board, are hinged together by flexible binding, such as the lining itself so that the panels can be folded angularly in relation to each other. The first two panels are essentially the same relative length and width while the third panel is of a shorter length and the fourth panel of a length shorter then the first three panels and hinged to the third panel with a ductile material, such as a thin aluminum strip. When a flexible hinge connects the third and fourth panels 38 and 41, a locking tongue cut from panels 38 and 41 can hold panel 41 upright for the same result. In use, the calendar pages on the front of panel two can be rotated over the hinge between panels one and two so as to be seen on the opposite side of panel 1. Either pockets can hold the pages to the panels or spiraled binding can be used as shown in FIG. 9 can be disposed at the hinge between the first and second panels to permit rotation of the pages. The hinge of the papers shown in FIGS. 10, 11 and 12, or in FIG. 9, is mounted between the second and third panels so that rotation of the pages, which are preferably longer than the base panel, places them atop of the upward edge of the fourth panel so that they are at an angle for viewing of upwardly extended pages as shown in FIG. 11 and have advertisements as well as phone numbers or other information thereon. Pages on the forward portion of the book can lie flat to permit better writing on this portion of the book with advertisement being confined to the opposite side of the pages for viewing. Listing of business concerns on the inside pages by trade can be adjacent A to Z listing of personal names and numbers, and may include listings and display ads with the first name of each letter. Other types of booklets can also be inside the desk calendar for retention on the desk and readily used with the flip forward position of panels one and two with the latter holding the book.

It should be clear at this point that the dual position desk calendar has been provided which allows three operative positions including the use of the desk calendar as an upright type desk calendar for across the desk viewing or a slant type of desk calendar for easy writing of memos and appointments on the calendar, and a pull forward panels for writing upon or displaying referenced information on the panels or in a book held by the panels. However, the present invention is not to be construed as limited to the forms shown which are to be considered illustrative rather then restrictive.

I claim:

1. A display mount comprising:

first, second, third and fourth panels, each having a plurality of edges;

the first panel being hinged to the second panel with a flexible hinge between one edge of the first panel and one edge of the second panel and the second panel being hinged to the third panel with a flexible hinge between one edge of the third panel and a second edge of the second panel and the third panel being hinged to the fourth panel with a ductile hinge material between one edge of the fourth panel and a second edge of the third panel, the first and second panels being of substantially the same length and the third panel being of a shorter length then the first and second panels and the fourth panel being of shorter length then the first, second and third panels, whereby the fourth panel can be bent on its bendable hinge relative to the third panel when the first and second panels are folded to lay on the fourth panel for displaying in one position and the first panel can be supported in an upright position with its edge on the third panel in a second displaying position, and the first and second panels can be folded for reference or writing upon; and polymer banding material banded around said first panel and said banding material supporting a plurality of sheets to said first panel.

2. A display mount in accordance with claim 1 in which said ductile hinge material is a thin aluminum strip.

3. A display mount in accordance with claim 1 in which said first, second, third and fourth panels are rectangular panels, each having the same width.

4. A display mount in accordance with claim 3 in which said first, second, third and fourth panels are case-bound together over one side of said panels.

5. A display mount in accordance with claim 1 in which said first and second panels are hinged with a spiral hinge.

6. A display mount in accordance with claim 5 in which said spiral hinge is a metal spiral hinge, hinging said first and second panels together and hinging a pad of sheets thereto between said first and second panels.

7. A display mount in accordance with claim 6 in which said pad of thin sheets includes sheets for writing upon.

8. A display mount in accordance with claim 7 in which said pad of thin sheets includes printed indicia thereon.

9. A display mount in accordance with claim 1 in which a space is formed between said fourth panel bent on its' bendable hinge relative to the third panel, and the first panel is supported in an upright position with its' edge on the third panel to form a space between the first and fourth panel for supporting a plurality of sheets therebetween.

* * * * *